US005290210A

United States Patent [19]

Hand et al.

[11] Patent Number: 5,290,210

[45] Date of Patent: Mar. 1, 1994

[54] AQUATIC STEP EXERCISE APPARATUS

[75] Inventors: Peter H. Hand, Atlanta; William J. Saunders, Lithonia; Eric Goldstein, Marietta; James B. Watson, Conyers; J. Charles Lockwood, Atlanta; J. Douglas Alsup, Conyers, all of Ga.

[73] Assignee: The Aqua Step Corporation, Atlanta, Ga.

[21] Appl. No.: 884,424

[22] Filed: May 15, 1992

[51] Int. Cl.[5] ..... A63B 21/00

[52] U.S. Cl. ..... 482/51

[58] Field of Search ..... 482/51, 52, 111; 108/51.1, 11, 12, 19, 155, 156, 157; 297/439

[56] References Cited

U.S. PATENT DOCUMENTS

| | | | |
|---|---|---|---|
| 3,393,940 | 7/1968 | Ellsworth et al. | 297/439 |
| 4,177,737 | 11/1972 | Brickman | 108/11 |
| 4,618,183 | 10/1986 | Bauer | 108/12 X |
| 4,627,613 | 6/1984 | Solloway | 482/111 |
| 4,759,544 | 7/1988 | Dias . | |
| 5,108,089 | 4/1992 | Wilkinson | 482/52 |
| 5,116,295 | 5/1992 | Dunn et al. | 482/111 X |
| 5,125,646 | 6/1992 | Wilkinson | 482/52 |

*Primary Examiner*—John J. Wilson
*Assistant Examiner*—Jeffrey A. Smith
*Attorney, Agent, or Firm*—Jones & Askew

[57] ABSTRACT

Step exercise apparatus primarily intended for use in an aquatic environment such as a pool or the like. The apparatus includes a step platform maintained in elevated relation above a foundation surface by a pair of support members. The apparatus has a specific gravity greater than one so as to sink within a body of water, and slots extend through the platform to prevent entrapment of air bubbles when the platform is placed in a pool. Handles in the sides and ends of the apparatus assist the user in manipulating the apparatus while exercising in the water. Removable extension feet selectively increase the step distance between the platform and the pool bottom or other foundation surface on which the apparatus rests.

17 Claims, 4 Drawing Sheets

AQUATIC STEP EXERCISE APPARATUS

FIELD OF INVENTION

This invention relates in general to exercise apparatus, and relates in particular to exercise apparatus primarily intended for use by a person while partially submerged in water.

BACKGROUND OF THE INVENTION

Exercise programs and equipment are used by many people for a variety of purposes. Some people are interested in maintaining or improving body strength, and those persons may exercise with free weights or with exercise machines designed or programmed to develop particular parts of the body. Persons may also engage in various aerobic exercise activities designed to improve respiratory and circulatory functions by increasing oxygen consumption of the body. Examples of aerobic exercise include running, walking, and swimming, and many people use exercise machines or devices such as treadmills, stair climbers, and aerobic step exercisers, to perform aerobic exercises indoor or within a relatively closed space.

Generally speaking, the foregoing kinds of exercises and exercise equipment should be used by persons in good physical health who are working to maintain or improve their strength or stamina. However, exercise routines may also be important for those who, by reason of illness, infirmity, or age, require physical therapy as a remedial treatment of bodily disorder. For example, persons who have undergone cardiovascular surgery or who are recovering from a heart attack may have prescribed a regimen of relatively light exercises to aid their physical rehabilitation. Exercise machines such as stair climbers or treadmills, even used sparingly, may simply be too stressful for many such therapeutic applications of exercise. Moreover, such exercise machines may appear intimidating to elderly or very infirm patients, who would feel more comfortable with exercises conducted in a familiar or nonthreatening environment.

SUMMARY OF INVENTION

Stated in general terms, the exercise apparatus according to the present invention is designed and intended for use in a body of water such as a swimming pool, although it is also contemplated that the present invention may also be used on land. For its intended use in an aquatic environment, the present invention comprises a step exerciser having a base to contact a foundation surface such as the bottom of a pool, and a level platform supported by the base a predetermined distance above the foundation surface. For use in an aquatic environment, the apparatus has a specific gravity slightly greater than one, so that the apparatus when submerged in a body of water will sink of its own accord to the bottom of that body and remain there while a person standing in the water alternately steps on and off the platform. The buoyancy of the water provides partial support for the body weight of the person using the present exercise apparatus in this manner, thereby reducing the cardiovascular and muscular stress required for each repetition of exercise. Moreover, the water impedes the movements of a person standing at chest height in a pool, thereby modulating the tendency of some persons to repeat the exercise movements at a rate greater than recommended for the particular health or physical condition of that person.

Stated somewhat more particularly, a step exercise apparatus according to the present invention includes a step platform and a pair of support members extending downwardly from opposite ends of the platform. A lower end of each support member provides a foot for contacting the pool bottom or other foundation surface on which the exercise apparatus remains while in use. An array of holes extend through the platform from the top to bottom, and these holes permit a substantial flow of water through the platform when the apparatus is moving through the water. These holes allow the heavier-than-water platform to sink to the bottom in an orderly manner without retaining air bubbles in the region beneath the platform of the apparatus. The holes in the platform also reduce the resistance of the platform to movement through water in other directions, for example, for exercises requiring that the platform be held in both hands in an upright position and alternately moved toward and away from the body of the person holding the platform.

The present exercise apparatus preferably has hand grips formed in the support members at each end of the platform, as well as separate hand grips formed at each side of the platform. These hand grips facilitate easy grasping and holding of the platform by a person holding the apparatus while standing in a pool. That person then can gently move the platform toward and away from the body as previously mentioned, or can hold the platform at arms length in the water while rotating the body from side to side, thereby working various muscles as the water impedes free movement of the exercise apparatus. The specific gravity of the present exercise apparatus preferably is not considerably greater than one, so that the apparatus has a slightly negative buoyancy allowing it to sink to the bottom as described above, but without being so heavy when at least partially submerged that the intended user cannot comfortably hold the apparatus for swinging or back-and-forth movement within the water.

Accordingly, it is an object of the present invention to provide an improved exercise apparatus.

It is another object of the present invention to provide an improved step exercise apparatus.

It is still another object of the present invention to provide a step exercise apparatus primarily intended for use submerged in a body of water.

It is a further object of the present invention to provide a step exercise apparatus that submerges in water without entrapping air beneath the apparatus.

Other objects and advantages of the present invention will become more readily apparent from the following description of a preferred embodiment.

DETAILED DESCRIPTION OF PREFERRED EMBODIMENT

Figure 1:
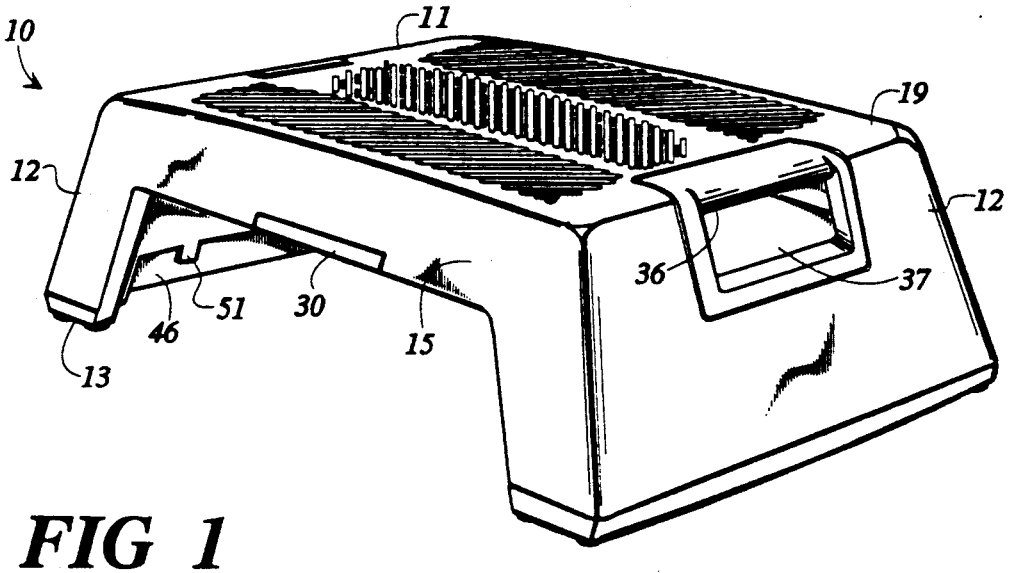
FIG. 1 is a pictorial view showing a step exercise apparatus according to a preferred embodiment of the present invention.
Figure 2:
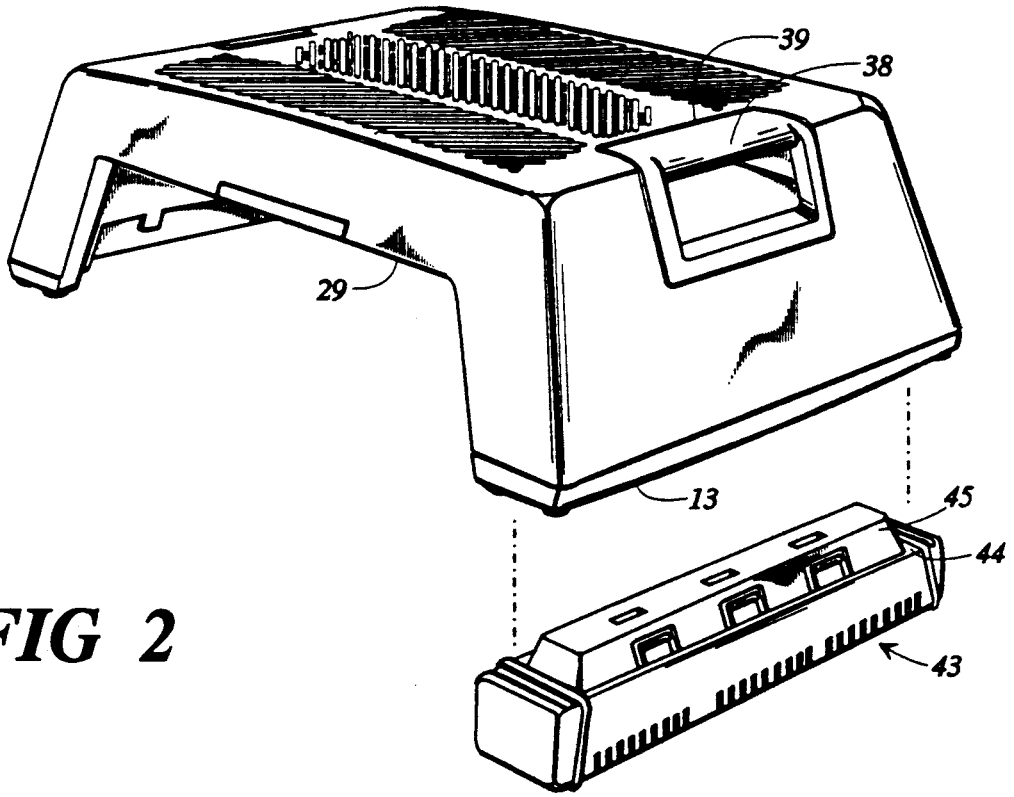
FIG. 2 is a pictorial view of the exercise apparatus as in FIG. 1, showing in exploded view an extension foot forming part of the apparatus.
Figure 3:
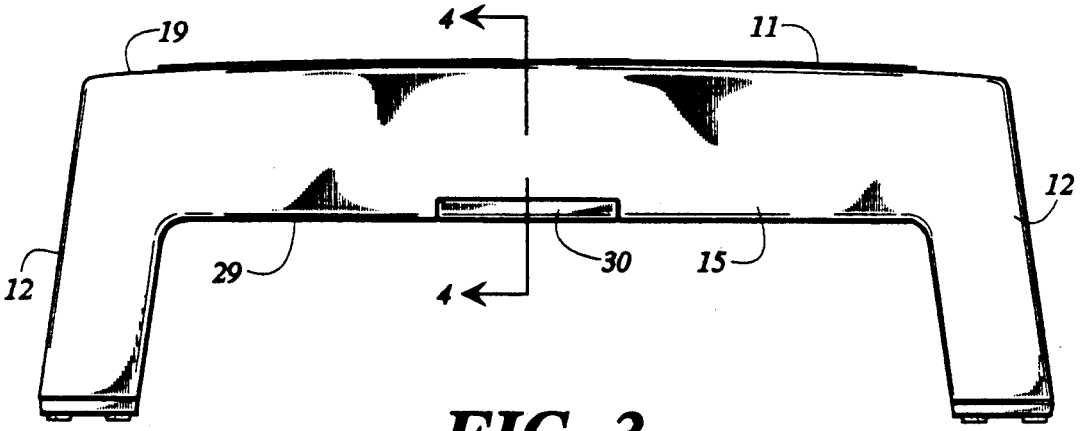
FIG. 3 is a side elevation view of the apparatus shown in FIG. 1.
Figure 4:
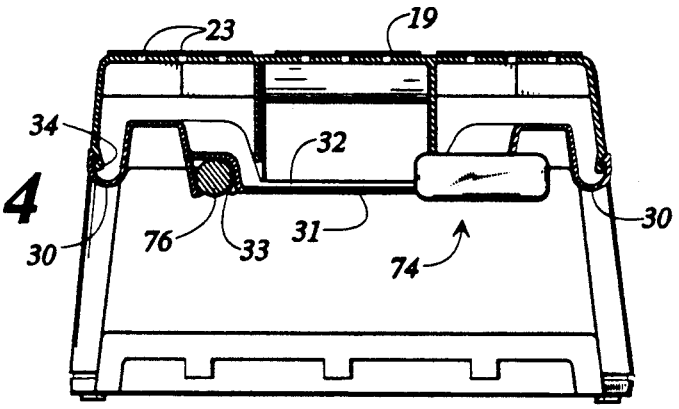
FIG. 4 is a section view taken along line 4—4 of FIG. 3.

Turning first to FIG. 1, there is shown generally at 10 a step exercise apparatus having a platform 11 of generally rectangular configuration. The two ends of the platform 11 join the corresponding support members 12 depending downwardly from the upper surface 19 of the platform. The bottom 13 of each support member 12 is intended to support the exercise apparatus 10 on a level foundation surface such as a floor or the bottom of a swimming pool, and each corner of both bottoms preferably is equipped with one or more skid-resistant elements such as the pads 14 (FIG. 6) of an elastomeric or other material providing relatively good adhesion on wet or slippery foundation surfaces. The sides 15 extend downwardly from the upper surface 19 of the platform 11 and form a skirt extending below the underside of the platform, as best seen in FIGS. 3 and 4. The apparatus 10 including the platform 11 and support members 12, as described thus far, preferably is a unitary article formed by injection molding of suitable plastic material such as mineral-filled polypropylene or the like. The preferred embodiment has a specific gravity somewhat greater than 1.0 so as to sink when immersed in water, for reasons that become more clear below, and mineral-filled polypropylene has a specific gravity of approximately 1.2. The preferred range of specific gravities for the present exercise apparatus is 1.15 to 1.4. However, the overall weight of the apparatus 10 in air should not be so great that the average user has difficulty in moving or carrying it.

Figure 5:
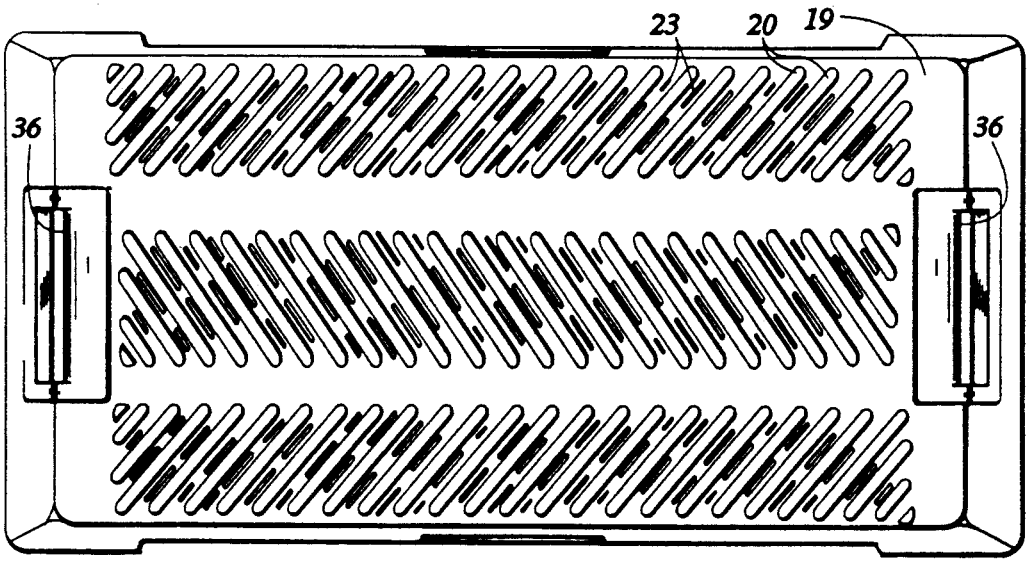
FIG. 5 is a top view of the apparatus shown in FIG. 1.

The upper surface 19 of the platform 11 is generally level. This upper surface is textured by one or more rows of lands or ridges 20 raised a short distance above the upper surface 19, to provide a firm footing for persons stepping onto and off the platform. Each land 20 has a generally smooth upper surface parallel with the upper surface 19 of the platform and, as best seen in FIG. 5, the lands are elongated and extend diagonally partway across the width of the platform 11. Three separate longitudinal rows of the lands 20 are provided in the disclosed embodiment, with the diagonal alignment of the lands in each row being offset approximately 90° from the lands in the adjacent row. Although the particular shape of the lands 20 is not considered critical to the present invention, the lands are on the upper surface 19 to improve the footing as a person alternately steps on and off the platform. The need for good footing on the platform is particularly important because the step exercise apparatus according to the preferred embodiment is intended for use submerged in a body of water, by someone who is barefoot and thus lacks the added traction of shoes worn during conventional land-based exercises.

The platform 11 is preferably solid through its thickness from the upper surface 19 to its under surface. This thickness is perforated by a number of individual slots 23 which, as best seen in FIG. 5, are generally interlaced between the adjacent lands 20 formed on the upper surface of the platform. The slots 23 thus also extend diagonally with respect to the length of the platform 11, as do the lands, and this diagonal arrangement increases the maximum slot length (and thus the aggregate open area provided by the slots) compared to slots extending across the width of the platform 19. The slots 23 through the platform 11 permit a substantial flow of water to flow through the platform when the exercise apparatus 10 moves through the water in a direction normal to the surface area of the platform. As will become apparent below, this movement of the exercise apparatus through the water can occur either when the apparatus is placed in a pool and allowed to sink to the bottom, or when the apparatus is manually held and manipulated by a person standing partially submerged within the body of water.

Figure 6:
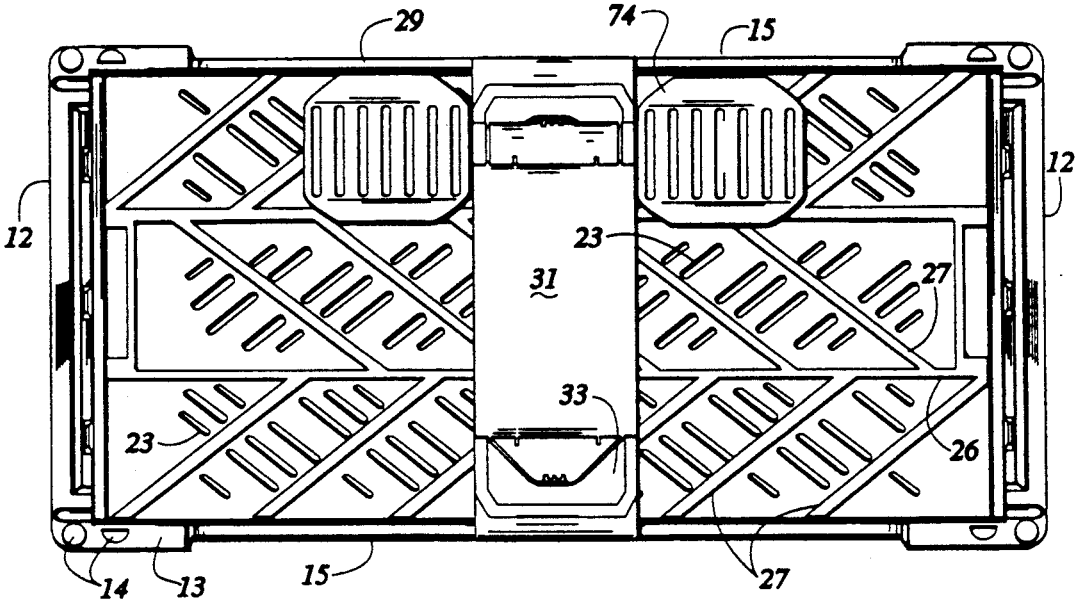
FIG. 6 is a bottom view of the apparatus shown in FIG. 1, with one hand wand removed for illustrative purposes.

FIG. 6 shows in detail the underside of the platform 11. That underside includes a pair of ribs 26 extending the length of the platform between the two support members 12. These ribs 26 preferably are molded as an integral part of the platform-support member structure and extend downwardly from the underside of the platform, thereby providing structural reinforcement to the platform sufficient to support the weight and impact of a person repeatedly stepping onto the platform. In this regard, it is preferred that the platform 11 and the entire exercise apparatus 10 be designed to support the forces anticipated in use on dry land, as such alternative use of the exercise apparatus is contemplated notwithstanding its intended primary use in connection with aquatic exercises by persons partially submerged in a body of water.

Interspersed between the longitudinal ribs 26 and the sides 15 on the underside of the platform 11 are three rows of diagonal ribs 27 extending in a herringbone pattern between and joining the sides of the exercise apparatus and the longitudinal ribs. These diagonal ribs likewise are integral with the platform 11 and extend downwardly therefrom, although to a lesser extent than the longitudinal ribs 26. The spacing between the adjacent diagonal ribs 27 is greater than the width of the slots 23 extending through the platform, so that several slots are disposed between at least some of the adjacent diagonal ribs. The diagonal ribs 27 and longitudinal ribs 26 join with the platform 11 and the side walls 15 to give that platform the strength and rigidity required of the present step exercise apparatus. The arrangement of diagonal ribs 27 in a herringbone pattern, with at least one slot 23 adjacent each diagonal rib, avoids any unvented recess beneath the platform in which air can become entrapped when the exercise apparatus is sinking in a pool or other body of water.

The sides 15 extend downwardly a distance from the upper surface 19 of the platform 11, terminating at a lower edge 29 below the lowermost extent of the ribs 26 and braces 27 on the underside of the platform. A handle 30 of generally round or smooth shape is located on each side 15 midway along the length of the lower edge 29. These handles 30 are formed at the ends of the shelf 31, best seen in FIGS. 4 and 6, which spans the width of the platform 11 with an upper surface 32 spaced downwardly from the ribs 26 on the underside of the platform 11. The ends of the shelf 31 terminate in upwardly-facing C-shaped channels configured for engaging and fitting over the mating recesses 34 on the lower edges 29 of the sides 15. The shelf 31 provides a relatively smooth underside for the exercise apparatus. A pair of generally-cylindrical sockets 33 is formed on the underside of the shelf 31, spanning the width of the shelf. These sockets provide a frictional or snap-lock fit for the handles of the manual exercise wands 74 described hereinbelow. The bottom side 35 of each handle 30 is rounded to provide a smooth surface for gripping the exercise apparatus by hand or moving the exercise apparatus by placing one's foot beneath the handle and flipping the exercise apparatus up from the bottom of a pool.

In addition to the handles 30 on the sides of the exercise apparatus, end handles 36 are provided at each end of the apparatus. These handles 36 are formed at the upper ends of the support members 12 and include an opening 37 extending through the support member near its upper end. Each end handle 36 comprises an insert member molded separately from the platform 11 and support members 12, and fitted into a recess provided for that purpose in the support member and end of the platform. Each end handle 36 has an upper portion 38, located at the top side of the opening 37 through the handle, having a rounded or arcuate surface for comfortably gripping the handle. The top edge 39 of that upper portion 38 preferably is contiguous to the upper surface 19 of the platform 11 so as not to interrupt the level surface of that platform. Likewise, the bottom edge (not shown) of the upper end portion 38 preferably provides a smooth transition with the under surface of the platform 11, thereby avoiding sharp edges or protrusions in the end handles.

Figure 8:
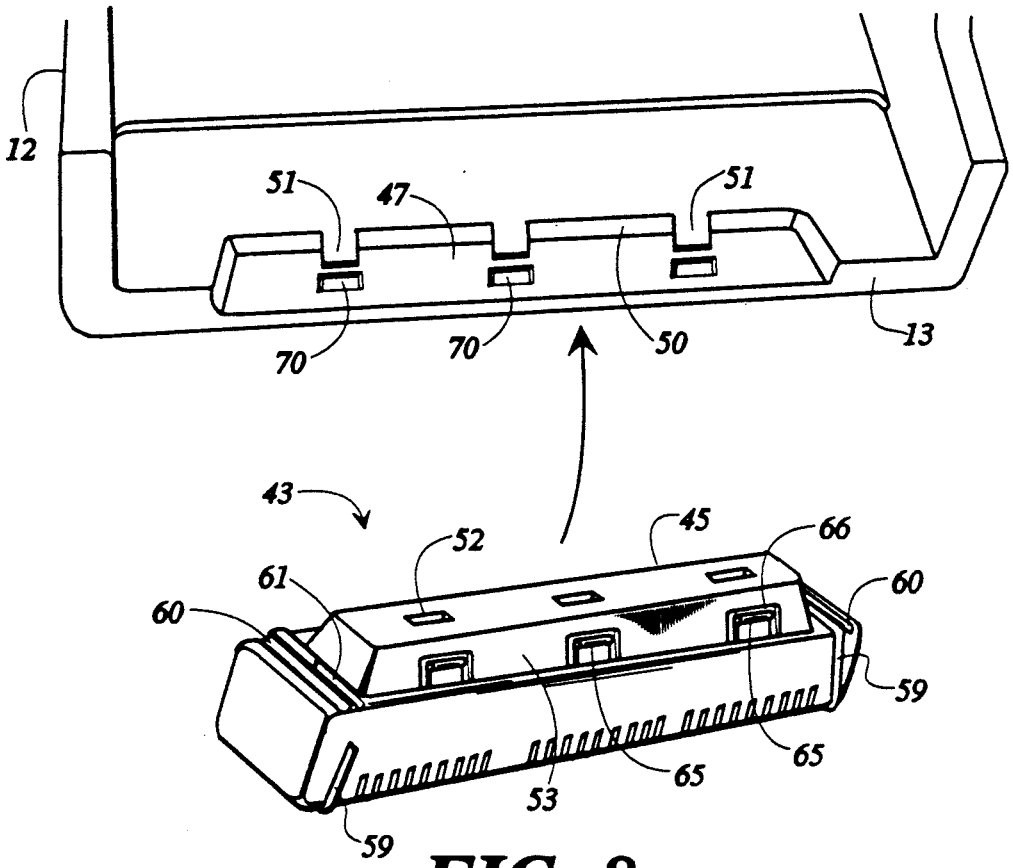
FIG. 8 is a partial pictorial view showing details of a support member and removed extension foot according to the preferred embodiment.
Figure 9:
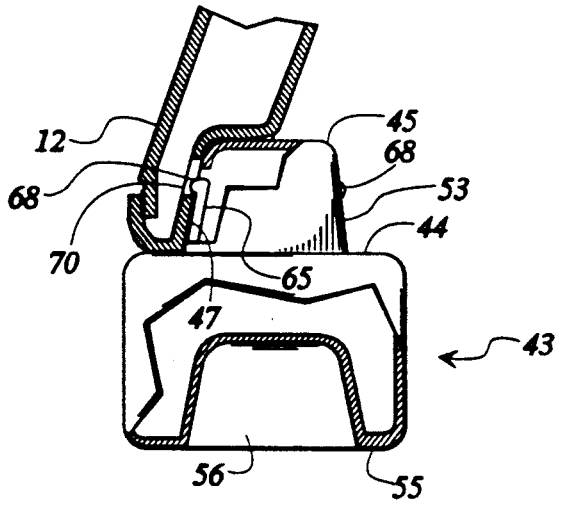
FIG. 9 is a fragmentary section view of the structure as in FIG. 8, showing the engaging structure holding an extension foot in place on the support member.

The exercise apparatus as described thus far allows a person stepping on and off the platform 11 to do work by repeatedly raising his or her body the distance the platform is elevated above the bottom 13 of the support members 12. That distance is seven inches in an actual embodiment of the present invention. For persons having the desire or ability of stepping greater heights, the elevation of the platform 11 can be raised by adding one or more extension feet 43 to the bottom of the support member 12 at each end of the platform. These extension feet 43 are best seen in FIGS. 8. An elongate rib 45 protrudes upwardly from the upper side 44 of each extension foot 43, and that rib is received within the complementary recess 46 extending inwardly from the bottom 13 of each support member 12. As best seen in FIG. 8, each recess 46 is indented into the thickness of a support member 12 at the bottom 13 thereof, so that the vertical wall 47 of the indented region forms one side of the recess 46. A horizontal ledge 50 extends outwardly from the top end of the vertical wall 47, forming the top of the recess 46. Several fingers 51 extend downwardly from the side of the ledge 50 remote from the vertical wall 47, these fingers defining the width of the recess 46 into which fits the rib 45 of the extension foot 43. These fingers 51 fit into the openings 52 (FIG. 8) in the outer surface of the rib 45, so as to locate the extension foot 43 in predetermined relation within the recess 46 at the bottom of the support member. The sides 53 of each rib 45 and the mating vertical wall 47 of each recess 46 preferably are somewhat tapered from vertical, as best seen in FIG. 9, so as to produce a snug fit when the rib 45 of the extension foot engages the recess. Each extension foot 43 preferably is symmetrical about its longitudinal axis, allowing the extension foot to fit within the recess 46 of either support member 12 without further alignment so long as those components are in parallel alignment with each other.

The lower side 55 of each extension foot has formed therein a longitudinal recess 56 complementary in shape to the rib 45 on the upper side 44 of the extension foot. This recess 56 allows stacking two or more extension feet 43, one atop the other, at the bottom 13 of each support member 12 as necessary or desired to further elevate the platform 11 above a foundation surface. To provide a firm grip for each extension foot 43 on a foundation surface or another extension foot, an elastomeric band 59 is fitted around each end of the extension foot. An O-ring of appropriate diameter and thickness is suitable for each band 59. The bands 59 are held in place at the ends of the extension feet 43 by engaging either an outer groove 60 formed in the upper and lower sides at each end of the extension foot, or an inner groove 61 spaced inwardly a short distance from the first such grooves. Each elastomeric band 59 thus can be retained in an inner groove 61 on the top of the extension foot and in an outer groove 60 on the bottom of that extension foot, thereby offsetting the band from top to bottom along the length of the extension foot. This offset alignment of the bands 59 allows stacking two adjacent extension feet one above the other, so that the outer groove 60 on the top of the lower stacked extension foot is available to receive the band 59 occupying the outer groove 60 on the bottom of the upper stacked extension foot.

Each extension foot 43 preferably undergoes a positive engagement with the support member 12 when that extension foot is in place on the adjacent support member. This positive engagement of the extension feet is obtained in the preferred embodiment by means of structure best seen in FIG. 9, including several locking tabs 65 received within openings 66 in each side 53 of the rib 45. The locking tabs 65 are substantially coplanar with the sides 53 of the rib 45 and are integrally joined to the sides of the rib by means of a relatively thin plastic web known as a living hinge, thereby maintaining each locking tab in alignment with the side 53 yet allowing the locking tabs to undergo deformable resilient movement inwardly from that side when displaced as mentioned below.

A protrusion 68 is formed at the free end of each locking tab 65. These protrusions extend outwardly from the plane of the rib sides 53, and each protrusion engages an edge of the notch 70 formed in the vertical wall 47 of the recess 46 in the support member 12 at each end of the exercise apparatus. This engagement takes place as the rib 45 of an extension foot 43 is inserted within the recess 46; the locking tab 65 is displaced within the opening 66 as the rib enters the recess until the protrusion 68 slides over the edge of the notch 70 confronting the locking tab, whereupon the resilient hinge moves the locking tab outwardly so that the protrusion engages the notch as shown in FIG. 9. The fingers 51 have entered the openings 52 in the rib 45 at this time, so that the rib is constrained from lateral movement away from the position shown in FIG. 9. The engagement of locking tab protrusion 68 within the notch 70 thus engages each extension foot 43 in place on the exercise apparatus, as that apparatus is lifted or moved from place to place in the feet-down position shown in FIG. 9. The extension feet 43 are removed from the support members 12 by grasping the extension foot and rocking it slightly to one side, thereby moving the protrusion 68 over the edge of the notch 70 and thereby permitting removal of the rib 45 from the recess 46.

As best seen in FIG. 8, a number of separate locking tabs 65 are provided along the length of each rib 45 for engaging a corresponding number of notches 70 disposed along the vertical wall 47 of the recess 46. Moreover, locking tabs 65 preferably are formed in both sides 52 of the ribs 46 as shown in FIG. 9. This arrangement of multiple locking tabs helps retain the extension feet in place when attached to the support members 12 of the exercise apparatus.

Figure 7:
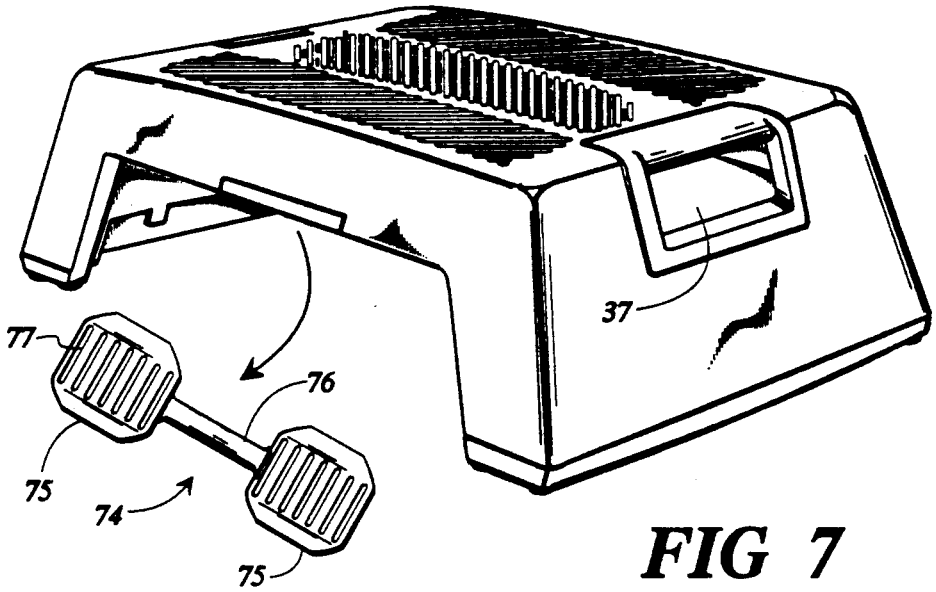
FIG. 7 is a pictorial view of the apparatus shown in FIG. 1, illustrating the removal of an exercise wand according to the preferred embodiment.

The shelf 31 on the underside of the platform includes the molded sockets 33 for receiving a pair of the exercise wands 74, best shown in FIGS. 6 and 7 and forming part of the present exercise apparatus. Each exercise wand has a pair of paddles 75 joined to opposite ends of the cylindrical handle 76. The shape and size of the handle 76 is selected so that the handle readily fits in the hand of a person using the exercise apparatus, and the handle holds the paddles apart on each side of the person's fist when holding the wand. The faces of each paddle are grooved as shown at 77 to increase resistance of the faces as the wand 74 is moved through the water. The paddles and handle of each wand 74 preferably are hollow so that the wands are relatively light in weight, and (unlike the preferred embodiment of step exercise apparatus 10) the wands may be designed to float in water so that the wands cannot sink to the bottom of a pool and become unaccessible to nonswimmers. Although the wands 74 superficially resemble in appearance the conventional exercise free weights known as dumbbells, it will be appreciated that the wands have minimal weight and thus are not used in the manner of dumbbells.

Some possible uses of the present exercise apparatus should now become apparent from the foregoing description. To use this exercise apparatus in an aquatic environment such as a swimming pool, the apparatus 10 is placed in the pool in an upright position as shown in FIG. 1. Because the specific gravity of the exercise apparatus is somewhat greater than one, the apparatus sinks toward the bottom and this sinking is aided by the slots 23 formed in the platform 11 of the apparatus. These slots allow an orderly flow of water through the platform 11 as the apparatus 10 sinks within the water, and the slots also prevent entrapment of air bubbles within the spaces formed by the ribs 26 and braces 27 on the underside of the platform. The somewhat concave overall inside shape of the exercise apparatus helps stabilize that apparatus when sinking in the water, preventing the apparatus from fishtailing from side to side while the apparatus undergoes a relatively controlled submersion. This concave shape, best seen in FIGS. 4 and 5, also makes the exercise apparatus 10 stackable, one atop the other, for storage when not in use.

Once the exercise apparatus 10 rests on the bottom of a pool, a person standing on the pool bottom can exercise simply by alternately stepping onto and off the platform 11. As previously mentioned, the lands 20 on the upper surface 19 of the platform provide the exerciser with the feel and reality of a relatively firm footing on the platform, and the skid-resistant pads on the bottom 13 of each support member helps prevent the exercise apparatus 10 from unwanted displacement along the pool bottom. One or more pairs of extension feet 43 can be added to the exercise apparatus as desired, increasing the vertical step between pool bottom and the platform 11.

The exercise apparatus 10 is also useful for other forms of exercise in a pool or other aquatic environment. For example, a person can manually hold the apparatus 10 by gripping the handles 30 on the sides 15, keeping the platform 11 in a vertical attitude with the support members 12 preferably facing away from the person. In this mode of use, the person is holding the exercise apparatus at arm's length in the water. The person then alternately moves the exercise apparatus toward and away from him, thereby working forearm and shoulder muscles as the exercise apparatus is moved through the water. The slots 23 in the platform 11 help reduce the resistance to movement in this form of exercise, and also help prevent the exercise apparatus from fishtailing through the water as the exerciser alternately pushes and pulls the apparatus through the water. The amount of water resistance in opposition to this push-pull movement can be adjusted by partially raising the exercise apparatus 10 out of the water.

Other forms of therapeutic exercise are obtained by holding the apparatus 10 by the end handles 36 while moving the apparatus through the water. For example, the apparatus can be slowly raised and lowered while held with the platform in a horizontal attitude, the exerciser accomplishing this movement by doing partial knee bends within the water. Alternatively, the exercise apparatus 10 can be held by one or both end handles in a vertical attitude while the exerciser pivots her body from side to side. These exercise performed while the exercise apparatus is partially or fully submerged are particularly useful for persons undergoing physical therapy or who otherwise are not advised to participate in more vigorous forms of exercise.

The wands 74 are optionally used by removing them from the shelf and gripping a wand in each hand. The exerciser then moves his or her hands through the water, holding the handle so as to keep the flat sides of the paddles 75 perpendicular to the direction of movement and thereby obtaining maximum resistance to movement of the wands through the water. The grooves 77 on the sides of the paddles provide additional resistance to movement through the water. The person thus does work against the resistance of the wands to movement through the water, instead of overcoming the relatively low mass of the wands.

It should be understood that the foregoing relates only to a preferred embodiment of the present invention and that numerous changes and alterations therein may be made without departing from the spirit and scope of the invention as defined in the following claims.

What is claimed is:

1. Step exercise apparatus comprising:

a body having base means to contact a foundation surface so as to provide stable support thereon for the apparatus;

a level step platform associated with the body in elevated relation to the base means and in generally parallel relation to a foundation surface on which the means rests, so that a person can alternately step on and off the step platform from the foundation surface;

sides extending downwardly from the step platform to form a skirt extending below the underside of the platform;

the apparatus having a specific gravity greater than 1.0 so as to sink when immersed in water; and apertures in the step platform to permit a substantial flow of water through the platform when the apparatus undergoes movement within a body of water in a direction normal to the platform, thereby reducing the resistance of the apparatus to such movement.

2. Apparatus as in claim 1, wherein:

the base means comprises a pair of support members depending from the platform in mutually spaced apart relation, and each support member having a lower end for contacting the foundation surface.

3. Apparatus as in claim 1, wherein:

the body has a long dimension terminating in ends and flanked by the sides; and each end has a handle operative to permit a person to grasp and hold the apparatus while alternately moving the apparatus toward and away from the person while in the water, as a form of exercise.

4. Apparatus as in claim 3, wherein:

each handle comprises an opening formed through an end of the body adjacent the platform and defined by a smooth upper surface contiguous to the platform so that the weight of the platform is substantially balanced when the apparatus is held by the end handles while the platform is substantially vertical.

5. Apparatus as in claim 1, wherein:

the body has a long dimension flanked by the sides; and each side has a handle operative to permit a person to grasp and hold the apparatus with the long dimension substantially vertical and the platform facing the person, while alternately moving the platform toward and away from the person while in the water as a form of exercise.

6. Apparatus as in claim 1, wherein:

the step platform is textured to provide a firm footing for persons stepping onto and off the platform; and the apertures are in the textured step platform.

7. Step exercise apparatus comprising:

a body having base means to contact a foundation surface so as to provide stable support thereon for the apparatus;

a level platform associated with the body in elevated relation to the base means and in generally parallel relation to a foundation surface on which the means rests, so that a person can alternately step on and off the platform from the foundation surface;

the platform having an upper surface with raised elements protruding outwardly from the surface, the raised elements providing a positive grip for the feet when stepping onto and off of the platform;

the apparatus having a specific gravity greater than 1.0 so as to sink when immersed in water; and apertures between the raised elements in the platform to permit a substantial flow of water through the platform when the apparatus undergoes movement within a body of water in a direction normal to the platform, thereby reducing the resistance of the apparatus to such movement.

8. Apparatus as in claim 7, wherein:

the raised elements comprise elongate ridges extending along the upper surface; and the apertures comprise elongate slots between the ridges.

9. Apparatus as in claim 8, wherein:

the elongate ridges extend substantially diagonal to the longitudinal axis of the platform.

10. Step exercise apparatus comprising:

a body having a base to contact a foundation surface so as to provide stable support thereon for the apparatus;

a level platform associated with the body in elevated relation to the base and defining a stepping surface in generally parallel relation to a foundation surface on which the base rests, so that a person can alternately step on and off the stepping surface from the foundation surface;

the base comprising a pair of support members depending from the platform in mutually spaced apart relation, and each support member having a lower end for contacting the foundation surface;

an extension foot removably attached to the lower end of each support member and thereby increasing the elevation of the platform above the foundation surface on which the extension feet rest;

the apparatus having a specific gravity greater than 1.0 so as to sink when immersed in water; and apertures in the stepping surface of the platform to permit a substantial flow of water through the platform when the apparatus undergoes movement within a body of water in a direction normal to the platform, thereby reducing the resistance of the apparatus to such movement.

11. Apparatus as in claim 10, wherein:

each extension foot has an element for engaging a mating locating element associated with the support member so as to provide a positive location of the extension foot in relation to the support member; and means on at least one of the extension foot and the support member for securing the extension foot in place on the support member, so that the extension member remains in place thereon when the platform is lifted off the foundation surface.

12. Step exercise apparatus comprising:

a body having base means to contact a foundation surface so as to provide stable support thereon for the apparatus;

a level platform associated with the body in elevated relation to the base means and having a stepping surface in generally parallel relation to a foundation surface on which the means rests, so that a person can alternately step on and off the stepping surface from the foundation surface;

the apparatus having a specific gravity greater than 1.0 so that the apparatus sinks when immersed in water;

apertures in the stepping surface to permit a substantial flow of water through the stepping surface when the apparatus undergoes movement within a body of water in a direction normal to the stepping surface, thereby reducing the resistance of the apparatus to such movement; and the base means comprises a pair of support members depending from the platform in mutually spaced apart relation and each having a lower end for contacting the foundation surface.

13. Apparatus as in claim 12, wherein:

the lower end of each support member has a recessed area; and further comprising an extension support foot removably attachable to the lower end of each respective support member;

each extension support foot having a bottom side for supporting the exercise apparatus on the foundation surface, and having a top side supporting the lower end of the support member and including protrusion means fitting into and engaging the recessed area therein, so that the extension support feet maintain a stable support for the platform while increasing the distance between the platform and the foundation surface.

14. Step exercise apparatus comprising:

a body having base means to contact a foundation surface so as to provide stable support thereon for the apparatus;

a level platform associated with the body in elevated relation to the base means and in generally parallel relation to a foundation surface on which the means rests, so that a person can alternately step on and off the platform from the foundation surface;

the platform having an upper surface with raised elements protruding outwardly from the surface, the raised elements providing a positive grip for the feet when stepping onto and off of the platform; and apertures between the raised elements in the platform to permit a substantial flow of water through the platform when the apparatus undergoes movement within a body of water in a direction normal to the platform, thereby reducing the resistance of the apparatus to such movement.

15. Apparatus as in claim 14, further comprising:

sides extending downwardly from the upper surface to form a skirt extending below the underside of the platform.

16. Step exercise apparatus comprising:

a body having a base to contact a foundation surface so as to provide a stable support thereon for the apparatus;

a level platform associated with the body in elevated relation to the base and in generally parallel relation to a foundation surface on which the base rests, so that a person can alternately step on and off the platform from the foundation surface;

the platform having an upper stepping surface with means on the surface to provide positive grip for the feet when stepping onto and off of the platform;

the apparatus having a specific gravity greater than 1.0 so as to sink when immersed in water; and apertures between the means on the stepping surface of the platform to permit a substantial flow of water through the stepping surface when the apparatus undergoes movement within a body of water in a direction normal to the platform, thereby reducing the resistance of the apparatus to such movement.

17. Step exercise apparatus comprising:

a body having a base to contact a foundation surface so as to provide stable support thereon for the apparatus;

a level platform associated with the body in elevated relation to the base and in generally parallel relation to a foundation surface on which the base rests, so that a person can alternately step on and off the platform from the foundation surface;

the base comprising a pair of support members depending from the platform in mutually spaced apart relation, and each support member having a lower end for contacting the foundation surface;

an extension foot removably attached to the lower end of each support member and thereby increasing the elevation of the platform above the foundation surface on which the extension feet rest;

the apparatus having a specific gravity greater than 1.0 so as to sink when immersed in water;

apertures in the platform to permit a substantial flow of water through the platform when the apparatus undergoes movement within a body of water in a direction normal to the platform, thereby reducing the resistance of the apparatus to such movement;

each extension foot having an element for engaging a mating locating element associated with the support member so as to provide a positive location of the extension foot in relation to the support member;

means on at least one of the extension foot and the support members for securing the extension foot in place on the support member, so that the extension member remains in place thereon when the platform is lifted off the foundation surface;

the securing means comprising a ledge on one of the support members and the extension foot; and a locking finger on the other of the support members and the extension foot, the locking finger being positioned for engagement of the ledge when the extension foot is positioned on the support member so as to retain the extension member in place, and being resilient so as to yield sufficiently for removal of the extension member in response to manual force exerted on the extension member.

* * * * *